US006105886A

United States Patent [19]

Hollstein et al.

[11] Patent Number: 6,105,886

[45] Date of Patent: Aug. 22, 2000

[54] POWDER SPRAY GUN WITH ROTARY DISTRIBUTOR

[75] Inventors: Thomas E. Hollstein, Amherst; Jeffrey R. Shutic, Wakeman; Michael Bordner, Green Springs, all of Ohio; Darryl Reagin, Riley, Mich.

[73] Assignee: Nordson Corporation, Westlake, Ohio

[21] Appl. No.: 08/896,628

[22] Filed: Jul. 18, 1997

Related U.S. Application Data

[63] Continuation-in-part of application No. 08/826,726, Apr. 7, 1997, Pat. No. 5,816,508, which is a continuation-in-part of application No. 08/444,785, May 19, 1995, abandoned.

[51] Int. Cl.[7] ..... B05B 3/10; B05B 5/04

[52] U.S. Cl. ..... 239/700; 239/703; 239/706; 239/105; 239/223; 277/395

[58] Field of Search ..... 239/700, 223, 239/224, 690, 704–708, 650, 105, 703; 277/392, 394, 395

[56] References Cited

U.S. PATENT DOCUMENTS

| | | | |
|---|---|---|---|
| 2,473,035 | 6/1949 | Meader et al. | 239/224 |
| 2,858,798 | 11/1958 | Sedlacsik | 239/700 X |
| 2,922,584 | 1/1960 | Slatkin | 239/703 X |
| 3,556,400 | 1/1971 | Gebhardt | 239/224 X |
| 4,214,708 | 7/1980 | Lacchia | 239/223 X |
| 4,518,119 | 5/1985 | Veffer | 239/223 |
| 4,589,597 | 5/1986 | Robisch et al. | 239/703 |
| 4,896,834 | 1/1990 | Coeling et al. | 239/704 X |
| 4,927,081 | 5/1990 | Kwok et al. | 239/223 |
| 4,936,510 | 6/1990 | Weinstein | 239/223 |
| 4,955,960 | 9/1990 | Behr et al. | 239/703 X |
| 5,100,057 | 3/1992 | Wacker et al. | 239/223 |
| 5,163,625 | 11/1992 | Takayama et al. | 239/690 X |
| 5,353,995 | 10/1994 | Chabert . | |
| 5,582,347 | 12/1996 | Knobbe et al. | 239/105 X |
| 5,632,448 | 5/1997 | Alexander et al. . | |

FOREIGN PATENT DOCUMENTS

| | | | |
|---|---|---|---|
| 3930186 | 12/1990 | Germany | 239/223 |
| 43 35 507 | 4/1995 | Germany . | |
| 839583 | 6/1984 | U.S.S.R. | 239/224 |

OTHER PUBLICATIONS

Patent Abstracts of Japan, vol. 008, No. 062 (C–215), Mar. 23, 1984 & JP 58 216751A (Tosyiyuki Kadowaki), Dec. 16, 1983. *abstract*.

*Primary Examiner*—Kevin Weldon
*Attorney, Agent, or Firm*—Rankin, Hill, Porter & Clark LLP

[57] ABSTRACT

A powder spray gun includes a rotary distributor which is capable of operating at slower speeds than liquid spray gun to reduce the problem of powder fusing, increases bearing life, reduce wear on moving parts while generating larger fan patterns and optimized charge transfer capabilities. The powder spray gun has a powder flow path which extends through a gun body to a powder outlet. The rotatable powder distributor is located at the powder outlet. A drive mechanism in the form of a motor is located within the housing and connected to the distributor the rotate the distributor. A spindle, which is mounted for rotation within the body, has a passageway therethrough which forms a part of the powder flow path. The distributor communicates with the passageway and is attached for rotation with the spindle. The powder thus enters the passageway in the rotating spindle before it passes into the rotating distributor. A chamber is formed within the body around the spindle, and the chamber is connected to an air supply to pressurize the chamber. A nonrotating flow tube through which powder flows into the passageway in the spindle, with a gap being formed between the nonrotating flow tube and the rotatable spindle. The gap communicates with the chamber whereby pressurized air from the chamber escapes through the gap to provide a rotary seal between the tube and the spindle. A sealing member may be used to prevent back flow of air through the gap.

30 Claims, 7 Drawing Sheets

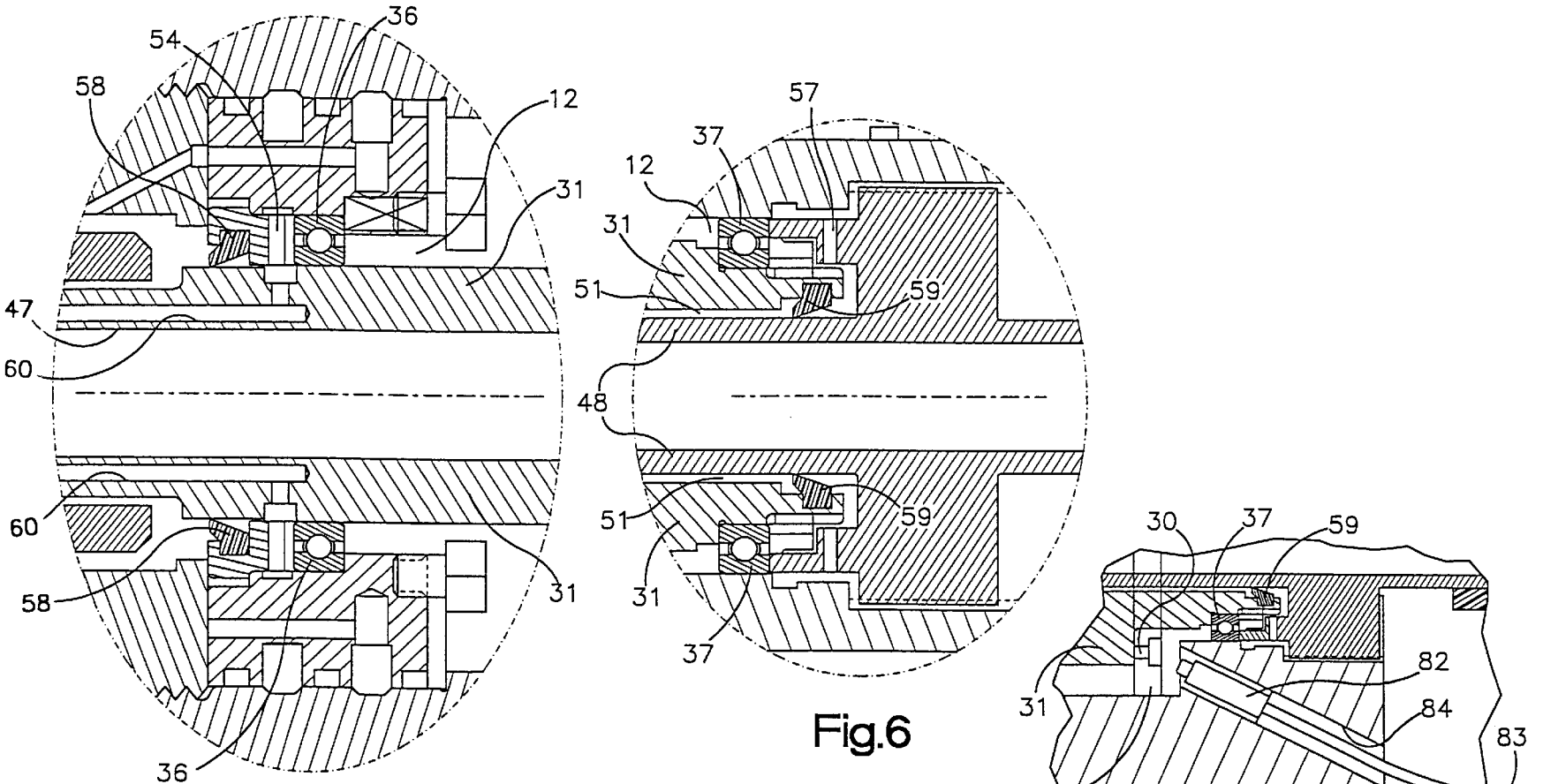
Fig.5
Fig.6
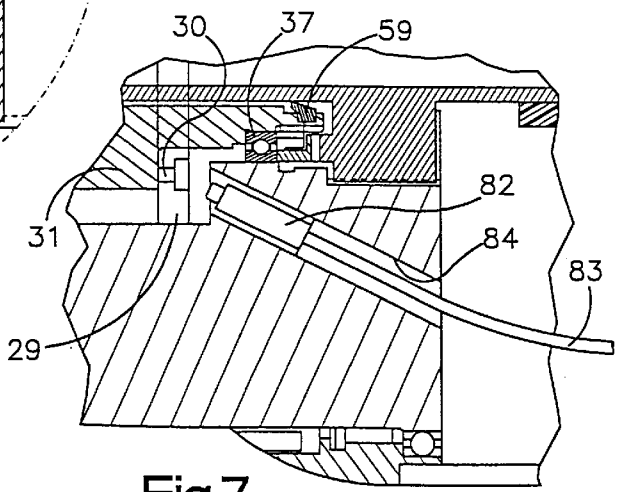
Fig.7

POWDER SPRAY GUN WITH ROTARY DISTRIBUTOR

CROSS REFERENCE TO RELATED APPLICATIONS

This is a continuation in part of application Ser. No. 08/826,726, filed Apr. 7, 1997, now U.S. Pat. No. 5,816,508 which is a continuation in part of application Ser. No. 08/444,785, filed May 19, 1995, now abandoned.

BACKGROUND OF THE INVENTION

1. Field of the Invention

This invention relates to electrostatic powder spray guns, and more particularly to a gun having a rotating member at the powder outlet for distributing the powder in a uniform spray pattern.

2. Description of the Prior Art

In electrostatic powder painting, dry paint particles are fluidized in a powder hopper and pumped with conveying air through a hose to one or more spray guns which spray the powder onto a product to be coated. The spray guns impart a charge to the powder particles, typically with a high voltage charging electrode. When the powder particles are sprayed from the front of the gun, they are electrostatically attracted to the product to be painted which is generally electrically grounded and which may be suspended from an overhead conveyer or otherwise carried in a spray booth. Once these charged powder particles are deposited onto the product, they adhere there by electrostatic attraction until they are conveyed into an oven where they are melted to flow together to form a continuous coating on the product. Powder coating technology offers significant economic and environmental advantages over solvent-based liquid painting operations. Recently, powder coating materials have been developed which enable automobile manufacturers to employ powder coating applications on vehicle bodies in order to accommodate ever-growing environmental regulations.

The most recently developed powders for automotive finishes are typically of fine particle size, with the particles size of 20 microns or less, in order to enhance the smoothness and appearance of the finished coating. This small size, coupled with the chemistry of the powder material, creates a tendency for the individual particles to agglomerate or stick together, forming large masses of powder which are capable of generating surface defects. These agglomerates are generated as a result of particle segregation as the powder is in motion during the fluidizing, material conveying and application phases of the application process. If these agglomerated masses make it through the application system without breaking up, they form small visible bumps on the part being coated. These bumps are sometimes known as "spits" or "powder balls." Once the finished surface passes through the oven, these bumps become visible defects which must be sanded smooth before the final top coating. In large numbers, they become labor intensive and time-consuming, even causing stoppage of the finishing line.

It is believed that powder spray guns with rotating distributors at the powder outlet provide improved and more uniform spray patterns and other benefits. The designs of many powder spray guns of this type have similarities to liquid spray guns that have rotating atomizers at the fluid outlet. Examples of liquid spray guns of this type are shown in U.S. Pat. Nos. 4,887,770 and 5,346,139. The rotating atomizers in liquid spray guns rotate at very high speeds, with a typical speed of such spray guns being around 20,000–50,000 rpm. These high speeds are necessary because the atomizers must atomize the liquid coating material, and the atomization is best achieved at these speeds. The guns are not generally designed to be capable of slower speeds, because slower speeds would not effectively atomize the liquid.

An example of a powder spray gun having design similar to one of these liquid spray guns is shown in U.S. Pat. No. 5,353,995, in which a powder spray gun has a rotating distributor or deflector at the powder outlet and in which the distributor is turned by means of a turbine located in the gun. The adoption of the designs of liquid spray guns having rotary atomizers to the design of powder spray guns having rotary distributors results in several problems.

One of these problems involves the use of the high-speed air turbine motor as the distributor driver. If the distributor in a powder spray gun rotates at speeds as high as 30,000–50,000 rpm, the powder particles will acquire a kinetic energy which will turn to heat as the powder particles contact the distributor, causing the powder to fuse onto the rotating distributor. The problem of powder fusing has become more acute as new powders have been developed which are finer in size and which are susceptible to fusing more easily.

In addition to the problem of powder fusing, some powder spray guns having rotary distributors which are currently commercially available have developed a reputation for being prone to creating agglomerates and "powder balls" or "spits." This problem results from the design of the powder path within the spray gun as well as the high rotational speed of the distributor.

Some of recently developed powders which are more prone to building up on the rotary distributor due to impact fusion, are also more likely to build up elsewhere in the powder flow path. Unlike liquids, powder tends to accumulate at various locations in the flow path, and such powder accumulations can have various adverse effects. The built-up powder can eventually break loose and become deposited on the part being coated. Powder can also accumulate in areas around the bearings of the rotating components, which can cause excessive wear on the components and impede the free rotation of the components.

Further problems arise where rotating members engage stationary members along the powder flow path, since a rotary seal is required at this point of engagement to prevent powder from entering between the rotating and stationary members and can eventually enter into the bearings. If enough powder enters the bearings, heat created by the friction of the bearings can cause the powder to cure, creating drag which further slows the rotating members, and which can even cause lockup in extreme cases. Conventional seals, such as lip seals, O-rings, wiper rings and U-cups, could be used to exclude powder from the bearings. However, these seals when conventionally mounted must be squeezed against the rotating surface in order to work properly. The squeezing force is objectionable because frictional drag is thus created which cannot be overcome without inordinately increasing the size of the drive train or the size and power requirements of the motor, and increasing the power would lead to increased heat dissipation problems. Also, the heat created by frictional drag would likely cause residual powder to cure on the seal, on the rotating members and on adjacent surfaces. In addition, these conventional seals are designed to operate against metal surfaces, usually hardened steel, and would be unsatisfactory where the rotating members and bearings are made of plastic material because of electrostatic charging concerns. Plastic materials do not approach the hardness of steel, and the squeezing force applied to conventional seals would cause wear of the plastic rotating members at the point of contact.

SUMMARY OF THE INVENTION

The problems of the prior art are obviated by the present invention which provides a unique powder spray gun having a rotary distributor. The spray gun of this invention is capable of operating at slower speeds than prior art spray guns, and thus the problems associated with powder fusing and agglomerates are reduced or eliminated. In addition, by operating at slower speeds, the spray gun of the present invention increases bearing life and otherwise reduces wear on moving parts within the gun while generating a larger spray pattern and optimizing charge transfer to the dispersed powder particles.

The spray gun of the present invention provides a rotating distributor which rotates at speeds which are much slower than the speeds of the prior art spray guns. Turbines, such as those used in prior art spray guns, can operate effectively only as slow as about 2,500 rpm. At slower speeds they will not operate at a consistent or even speed, or may not operate at all. The present invention avoids the use of a turbine to turn the distributor, so that it can achieve much slower speeds effectively. The distributor in the gun of the present invention can rotate evenly and consistently at speeds of from 0 to 2,500 rpm, and preferably at speeds of from 750 to 1,500 rpm.

The rotating distributor in the powder spray gun of the present invention does not function like a rotating atomizer in a liquid spray gun. The primary purpose of an atomizer is to atomize the liquid, that is, provide liquid droplets of the desired size. The particle size of powder is established during the manufacturing of the powder, so the distributor has no effect on particle size. Instead, the distributor provides the desired dispersion characteristics for the powder. The distributor blends the variations in the particle stream density which typically occur in positive pressure powder conveying hoses. Unlike a liquid applicator which is fed by a pressurized fluid stream with a constant pressure and density, because it is a non-compressible medium, powder flow is found to have a region of dense flow within the inside diameter of the supply hose. Rotating the deflector and nozzle assembly imparts a side force to the particle stream which results in blending of the variations in stream density prior to the particles being discharged from the distributor.

Because the rotation of the distributor is primarily a blending function, not an atomizing function, the distributor can be rotated at a speed much slower than a liquid atomizer. This slower rotational speed results in longer bearing life and less wear on rotating parts. The lower rotational speed also, surprisingly, results in a larger fan pattern, although it would be assumed that higher rotational speeds would result in larger fan patterns.

The fundamental operating criteria of the powder spray gun of the present invention thus involves determining the minimum operating speed required to achieve optimum dispersion characteristics or discharge density, while at the same time maintaining the largest pattern size as a result of the higher departure angle achieved by the lower speed. The resulting consistent discharge density is also beneficial to charge transfer in corona charging applications. The optimum speed range has been found to occur between 750 and 1,500 rpm, depending upon the specific application criteria.

This speed range cannot be realized with an air turbine drive system, and one of the benefits of the present invention is the configuration and drive system, preferably including an electric motor, in order to achieve the appropriate speed. An air motor or other suitable motors can also be effectively used. As compared with the air turbines used in the prior art, an air motor or an electric motor is relatively inexpensive. In addition, an electric motor or air motor or other comparable motor can be easily replaced if it fails or becomes worn.

Unlike the prior art designs which required the turbine to be mounted coaxially with the rotatable distributor, the motor used in the spray gun of the present invention is radially offset from the central axis of the gun, so that the central axis can be devoted to the powder flow path. By locating the drive means along an axis which is spaced from the central longitudinal axis of the spray gun, an unencumbered flow path is provided for the powder and a simplified gun design is achieved. The resulting clear, unimpeded path for the powder has no changes in powder flow direction, and no significant obstructions or impediments in the powder flow path on which powder could accumulate.

The spray gun of the present invention inhibits the formation of agglomerates during application and breaks up agglomerates which may already exist in the powder prior to arriving at the spray gun. The inhibition of agglomerate formation is accomplished by providing a rotating distributor with a slower rotation speed as well as by providing a smooth powder path and a diffuser membrane deflector face. The break-up of existing agglomerates is accomplished by providing a high shear force area at the nozzle exit.

The problem of powder accumulations elsewhere in the gun is avoided by providing a pressurized air channels to a rotating spindle which has a central passageway forming part of the powder flow path. The channels are connected to a supply of pressurized air, and the entire chamber around the spindle is thus pressurized slightly above the pressure of the fluidized powder flow through the gun. Air from the channels can escape around the spindle and around its associated bearings, and when the air escapes, it effectively sweeps powder from the periphery of the spindle, keeping the areas around the spindle and the bearings clean of powder. In addition, the air escapes through an annular gap formed between the stationary powder supply tube and the rotating spindle, providing an effective rotary seal without the necessity of additional components.

Since the powder flow path may be exposed to high pressure air, such as during pump purging operations and gun cleaning, the air seal is covered by a supplemental sealing element. This seal preferably takes the form a lip seal made of elastomeric material which is mounted so that it rests lightly against the spindle and will move away from the spindle as air escapes from the pressurized chamber and will move into sealing engagement with the spindle if increased air pressure is introduced into the powder flow path. The rotary seal provided by this invention avoids the problems of friction created between the rotating spindle and the stationary tube which would otherwise accelerate wear and tend to cause increased powder fusing. At the same time, the seal effectively prevents powder infiltration during cleaning operations and other times when high pressure air enters the powder flow path.

The overall design of the spray gun of the present invention is thus simpler, relatively inexpensive to manufacture and maintain, and easier to operate. The parts are arranged in a modular design, making it easy to replace parts.

These and other advantages are provided by the present invention of a spray gun for spraying coating material which comprises a housing including a body. A spindle is mounted for rotation within the body. The spindle has a rotating tubular passageway therethrough for the flow of coating material path. The passageway rotates with the spindle, the passageway having first and second ends. There is a non-rotating flow tube through which powder flows into the rotating tubular passageway. One end of the flow tube extending partially into the first end of the passageway and spaced within the passageway from the second end. A distributor communicates with the passageway and is attached for rotation with the spindle. Coating material flows from the passageway into the distributor to be sprayed from the gun. A drive mechanism is located within the body and connected to rotate the spindle and the distributor at speeds of from 0 to 2,500 rpm, and preferably at speeds of from 750 to 1,500 rpm.

In accordance with another aspect of the present invention, a gap is formed between the nonrotating flow tube and the rotatable spindle. The gap communicates with the chamber whereby pressurized air from the chamber escapes through the gap to provide a rotary seal between the tube and the spindle. A flexible sealing member is capable of engaging the flow tube to seal the gap to prevent material in the passageway from entering the gap. The sealing member is urged away from the flow tube by pressurized air from the chamber.

BRIEF DESCRIPTION OF THE DRAWINGS

FIG. 5 is a detail of a portion of FIG. 2 to a larger scale showing one of the sealing members.

FIG. 6 is a detail of another portion of FIG. 2 to a large scale showing the other sealing member.

FIG. 7 is portion of a side sectional view of the spray gun similar to FIG. 2 showing a different cross section taken along line 7—7 of FIG. 4.

DETAILED DESCRIPTION OF THE PREFERRED EMBODIMENT

Figure 1:
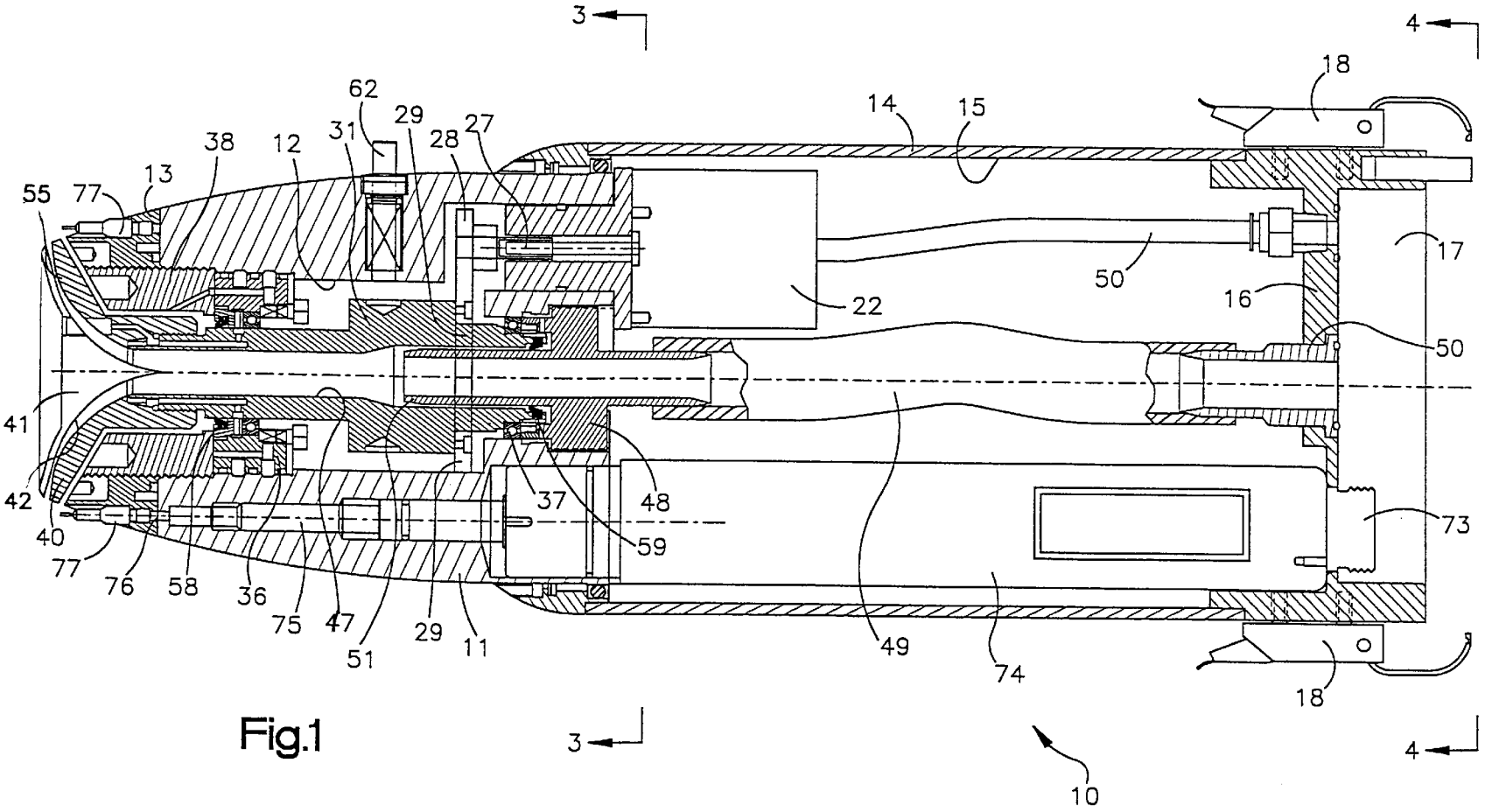
FIG. 1 is a side sectional view of the spray gun of the present invention.

Referring more particularly to the drawings and initially to FIG. 1, there is shown a powder spray gun 10 according to the present invention comprising a housing including a body 11. The body 11 is formed of a nonconductive plastic material and has a central chamber 12. The forward end of the chamber 12 is enclosed by a front end cap 13 which is also formed of a nonconductive plastic material and which is threadedly attached to the front of the body 11. A tubular housing sleeve 14 having a hollow interior 15 is attached to the body 11 and extends rearwardly from the body. A rear body member 16 is mounted on the rear of the sleeve 14, and a rear end panel member 17 is removably mounted on the rear of the body member 16 by a pair of clamping assemblies 18. Instead of the clamping assemblies 18, the rear end panel member 17 can be mounted on the rear of the body member 16 by a threaded connection or by other means.

Figure 2:
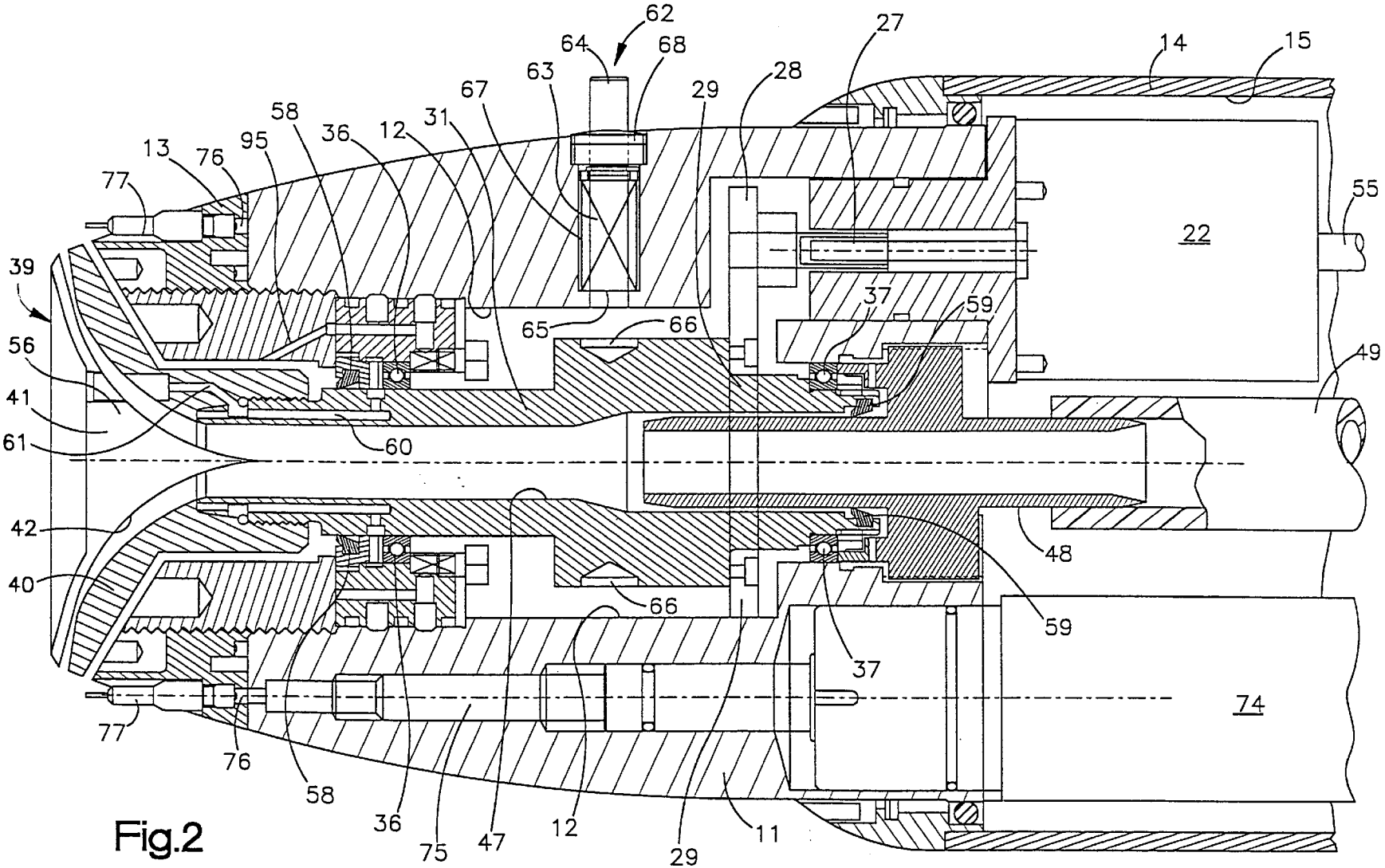
FIG. 2 is a detailed view of a portion of FIG. 1 to a larger scale.
Figure 4:
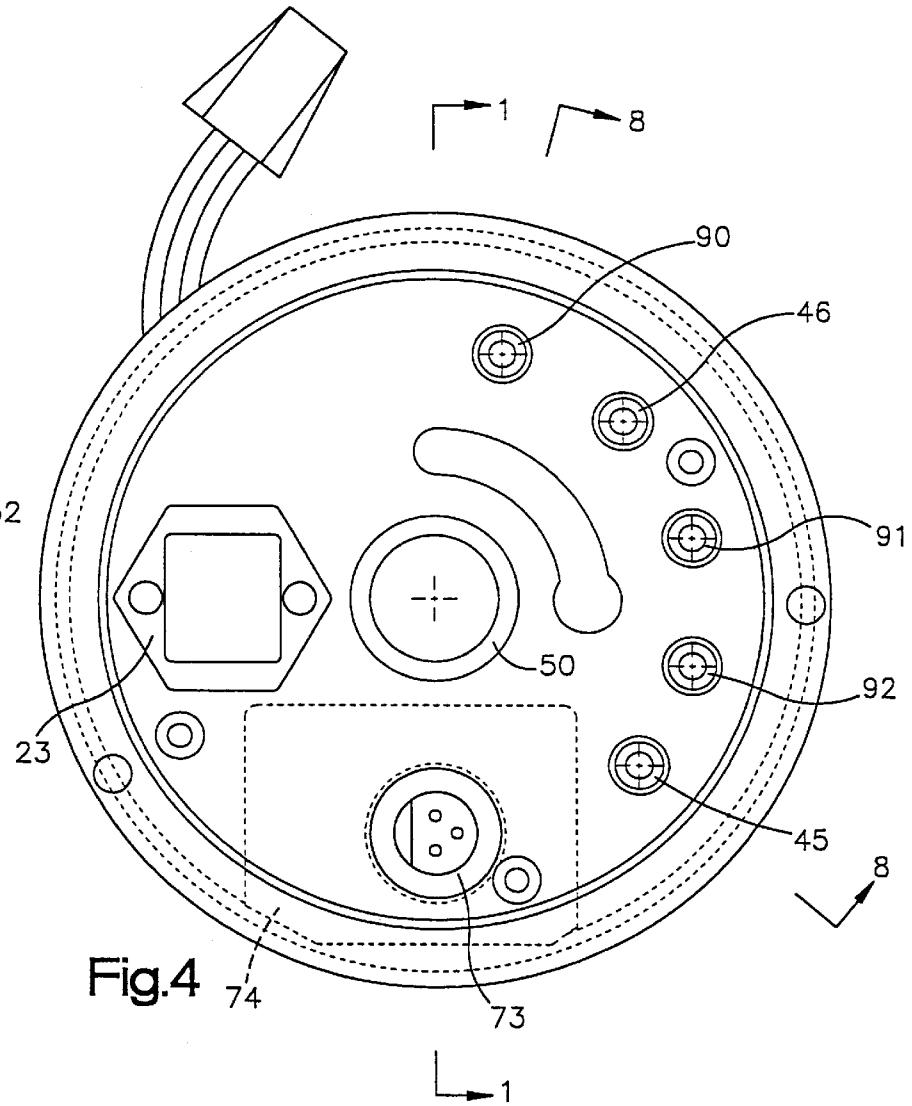
FIG. 4 is an end elevational view of the spray gun taken along line 4—4 of FIG. 1.
Figure 3:
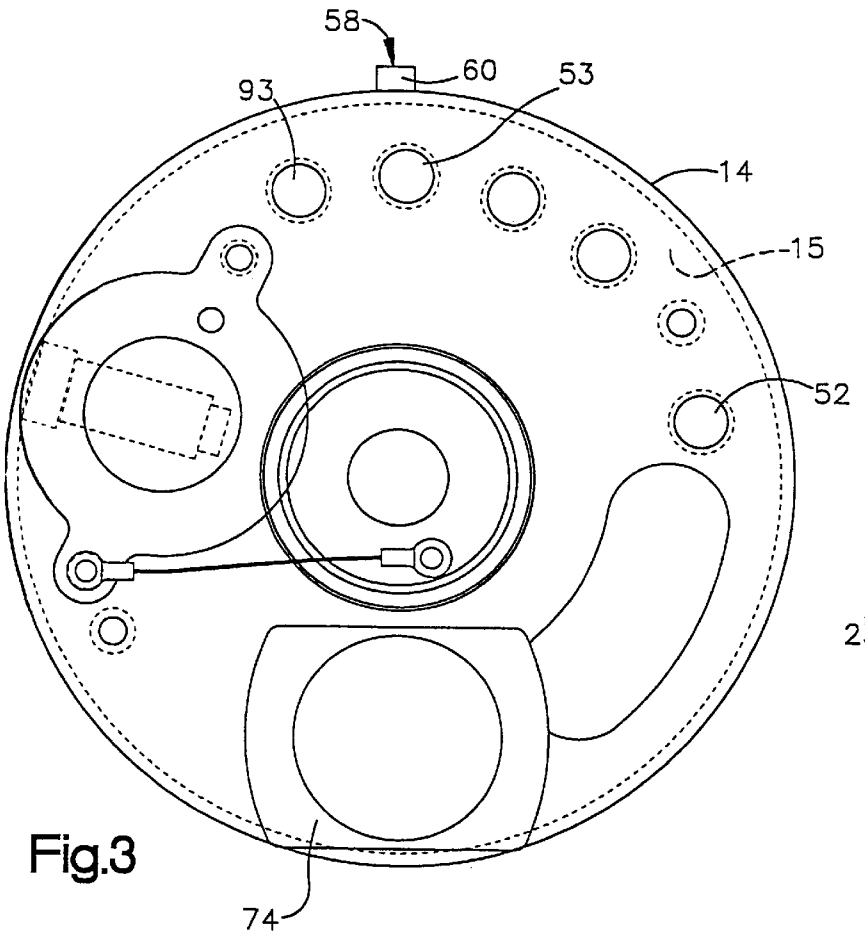
FIG. 3 is an end sectional view of the spray gun taken along line 3—3 of FIG. 1.

A drive mechanism comprising a motor 22 is mounted in the body 11 and extends rearwardly from the body in the sleeve interior 15. The motor 22 is a small electric motor. The motor 22 is connected to an electrical supply line (not shown) which extends through the sleeve interior 15 and is connected to a connection 23 at the rear end panel 17 (FIG. 4). The motor 22 has an output shaft 27 (FIG. 2), and the motor turns the shaft at various speeds depending upon the control of the motor. A typical shaft rotational speed would be between 0 and 4,500 rpm. A gear 28, which is mounted on the shaft 27 engages another gear 29 which attached by means of screws 30 to a spindle 31 rotatably mounted in the chamber. The gears 28 and 29 produce a suitable gear reduction, e.g., 3 to 1, which decreases the rotational speed of the spindle 31 and increases the torque produced by the air motor 22.

The spindle 31 rotates within the chamber 12 in the body 11, and is supported on front and rear bearing assemblies 36 and 37. A bearing retainer 38, which is threadedly mounted on the front of the body 11 and which covers the chamber 12, is located between the front bearing assembly 36 and the front end cap 13 and holds the front bearing assembly 36 in place. A two-piece rotatable powder distributor or nozzle assembly 39 is mounted on the front end of the spindle 31. The nozzle assembly 39 comprises a inner nozzle member 40 and an outer nozzle member 41. The inner nozzle member 40 is threadedly connected to the front end of the spindle 31 to rotate with the spindle. The outer nozzle member 41 is spaced from the inner nozzle member 40 with a smooth, curved flowpath 42 therebetween for the passage of powder, and the outer nozzle member is press fit onto the inner nozzle member 40, so that the outer nozzle member rotates with the inner nozzle member.

The smooth, curved flowpath 42 is formed between the conically shaped inner nozzle member 40 and the corresponding shaped outer nozzle member 41. The flowpath 42 provides a gradual tapered curve, causing the powder to change direction from an axial direction to a more radial direction toward the exit point. This direction change is accomplished by the shape of the flowpath 42 so that it occurs in a smooth, controlled manner, with a minimum of turbulence. This helps to inhibit the formation of agglomerates which could otherwise result in "powder balls" or "spits" on the finished surface. The flowpath 42 has latitudinal profile which is defined as the interior surface of the outer nozzle member 41. The length of this latitudinal profile is the length of the flowpath 42 along the interior surface of the outer nozzle member 41 from the entrance 71 of the nozzle to the powder discharge outlet 72. This length is measured from the point 78 at which the conical tip of the outer nozzle member 41 extends into the passage 60 to the edge 79 of the outer nozzle member at the discharge outlet.

The flowpath 42 also includes a high shear force region 55 which helps to break up existing agglomerates in the powder supply. At the region 55, the radial clearance between the inner nozzle member 40 and the outer nozzle member 41 is reduced to a minimum gap which causes a high shear force as the powder exits the spray gun. The high shear force is created as the powder flow accelerates through the gap and decelerates after passing through the gap. The optimum gap characteristics which create the appropriate shear force are based upon a discrete group of coordinates along the overall profile of the nozzle passage, with the critical reduction (or acceleration) region 55 occurring at a point at least 70% of the length of the latitudinal profile, preferably at least 80% of the length of the latitudinal profile, and more preferably approximately equal to 82% of the length of the latitudinal profile. In other words, the region 55 preferably occurs at an intermediate location which is about 82% of the distance of powder flow from the entrance 71 of the nozzle to the powder discharge outlet 72. Longitudinal or circumferential profiles for both the inner and outer profiles of the nozzle result in various cross sectional areas, the smallest of which preferably occurs at about this 82% point along the length of the latitudinal profile. The high shear force region should be at approximately this location, but it may be between 72% to 92% of the length of the latitudinal profile. The intermediate region 55 thus provides for the smallest cross sectional area through the nozzle. The cross sectional areas at the nozzle entrance and outlet 71 and 72 should be significantly larger than this cross section, with the nozzle entrance 71 at least 20% larger and the outlet 72 at least twice as large. Preferably, the cross sectional area of the nozzle entrance 71 then would be about 1.54 times greater than the cross sectional area at the location of the intermediate region 55, and the cross sectional area at the powder discharge outlet 72 would be about 4.81 times greater than the cross sectional area at the location of the intermediate region 55. In the preferred embodiment, the flowpath narrows at the region 55 to a width of approximately 0.015 to 0.020 inches, and preferably between 0.017 and 0.019 inches.

The rotating distributor 39 in the powder spray gun 10 does not function like a rotating atomizer in a liquid spray gun. The primary purpose of an atomizer is to atomize the liquid, that is, provide liquid droplets of the desired size. The particle size of powder, on the other hand, is established during the manufacturing of the powder, so the action of the distributor has no effect on particle size. Instead, the distributor 39 is designed to provide the desired dispersion characteristics for the powder. The distributor blends the variations in the particle stream density which typically occur in positive pressure powder conveying systems. This condition is sometimes referred to as "roping," and it is confirmed by observations of conventional powder guns with either flat spray or conical nozzles. Variations in pattern density as a result of the roping result in striations or fingers, which are actually denser regions of the fan pattern due to the initial contact of the powder stream with the deflector. Unlike a liquid sprayer which is fed by a pressurized fluid stream with a constant pressure and density (because liquid is a non-compressible medium), a region of dense flow occurs within the inside diameter of the supply hose in a pressure powder air conveying system. This dense region is not usually concentric within the powder hose; it occurs in the region of the highest velocity of the powder flow in the hose. As a result, the most stable delivery flow rate will not result in a consistent discharge of particles across a given diameter. In the past, attempts to overcome this characteristic have usually involved some form of dilution air at the applicator itself, but the effect of this is arbitrary at best, and the additional air volume at the point of application is detrimental to transfer efficiency.

In accordance with this invention, the distributor or nozzle assembly 39 is rotated, and this rotation imparts a side force to the powder particle stream which results in blending of the variations in stream density prior to the particles being discharged from the distributor. The amount of side force transferred to the particles is a function of the rotational speed of the distributor. Unlike a liquid atomizer, the total force transferred by the rotating powder distributor is very low due to the almost total lack of cohesive properties of powder particles. As a result, the conveying air of the powder stream is the primary force that ejects the particle from the distributor, just as it is in the case of conventional powder applicators without rotating distributors. The rotation is primarily a blending function, not a function which has a great effect on the fan pattern.

It has been found in accordance with this invention that excessive rotation speed has disadvantages beyond the realm of bearing life and overall wear issues. Most would assume that higher rotational speeds would result in larger fan patterns. However, surprisingly, the opposite has been found to be true. A rotating distributor achieves its largest pattern when it is not rotating. Without rotation, the powder particles exit straight out from the center of the device, perpendicular to the edge of the bell cup deflector. As the deflector begins to rotate, a pinwheel effect is observed in which the particles begin to exit the edge of the deflector at an angle of less than 90°. As the rotational speed increases, the exit angle becomes shallower. The primary ejection force, however, is still the conveying air of the particle stream, not the rotation of the deflector. As a result, the inertial properties of a given particle are constant, and the overall distance of a given particle is equal, but the relative distance of the particle from the applicator center point is less due to the smaller exit angle, resulting in a smaller overall pattern.

The fundamental operating criteria of the spray gun thus involves a determination of the minimum operating speed required to achieve optimum dispersion characteristics or discharge density, while at the same time maintaining the largest pattern size as a result of the higher departure angle achieved by the lower speed. The resulting consistent discharge density is also beneficial to charge transfer in corona charging applications. The optimum speed range has been found in accordance with this invention to occur between 750 and 1,500 rpm, depending upon the specific application criteria. This speed range cannot be realized with an air turbine drive system, and one of the benefits of the present invention is the configuration and drive system, preferably including an electric motor, in order to achieve the appropriate speed.

The slower rotational speed of between 750 and 1,500 rpm also helps to inhibit the formation of agglomerates which would otherwise tend to occur if the distributor rotated at higher speeds.

The spindle 31 has a central interior passageway 47 through which powder flows. The interior passageway 47 communicates with the flowpath 42 between the nozzle members 40 and 41, so that powder flowing through the passageway in the spindle 31 flows directly into the flowpath between the nozzle members. Powder enters the passageway 47 in the rotating spindle 31 from a nonrotating tube member 48 which extends into the rear of the spindle. The tube 48 extends rearwardly from the spindle 31 and is connected to one end of a hose 49 which extends through the center of the sleeve interior 15. The other end of the hose 49 is connected to a fitting 50 on the rear end panel 17 where it can be connected to a suitable powder supply hose (not shown). The supply hose can be connected to a conventional powder supply system comprising a fluidized powder hopper, a pump and a control module. The forward end of the tube 48 extends partially into the spindle passageway 47, and an annular gap 51 is thus formed between the stationary tube 48 and the rotating spindle 31.

Figure 2A:
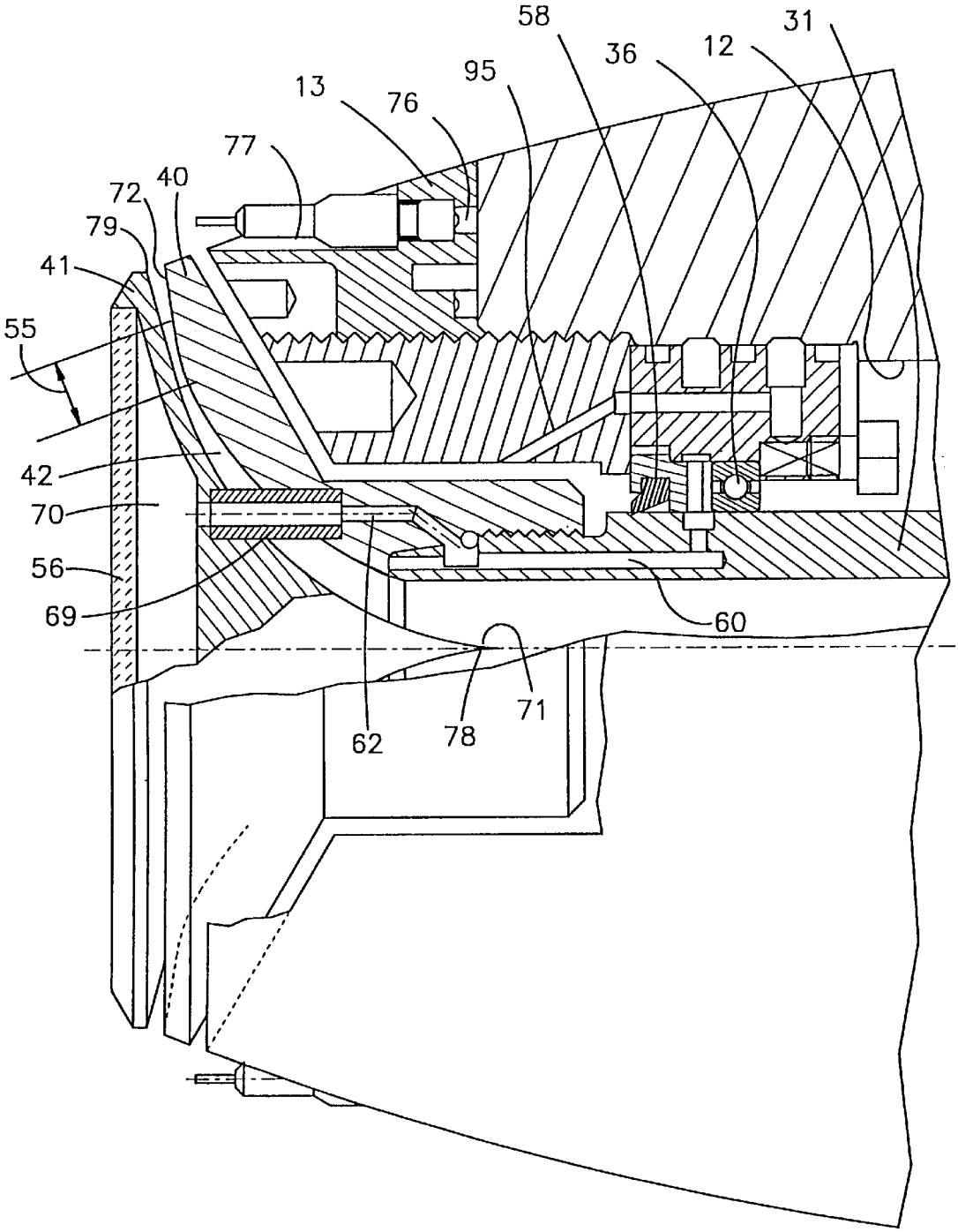
FIG. 2A is a more detailed view of a portion of FIG. 2 to an even larger scale.
Figure 8:
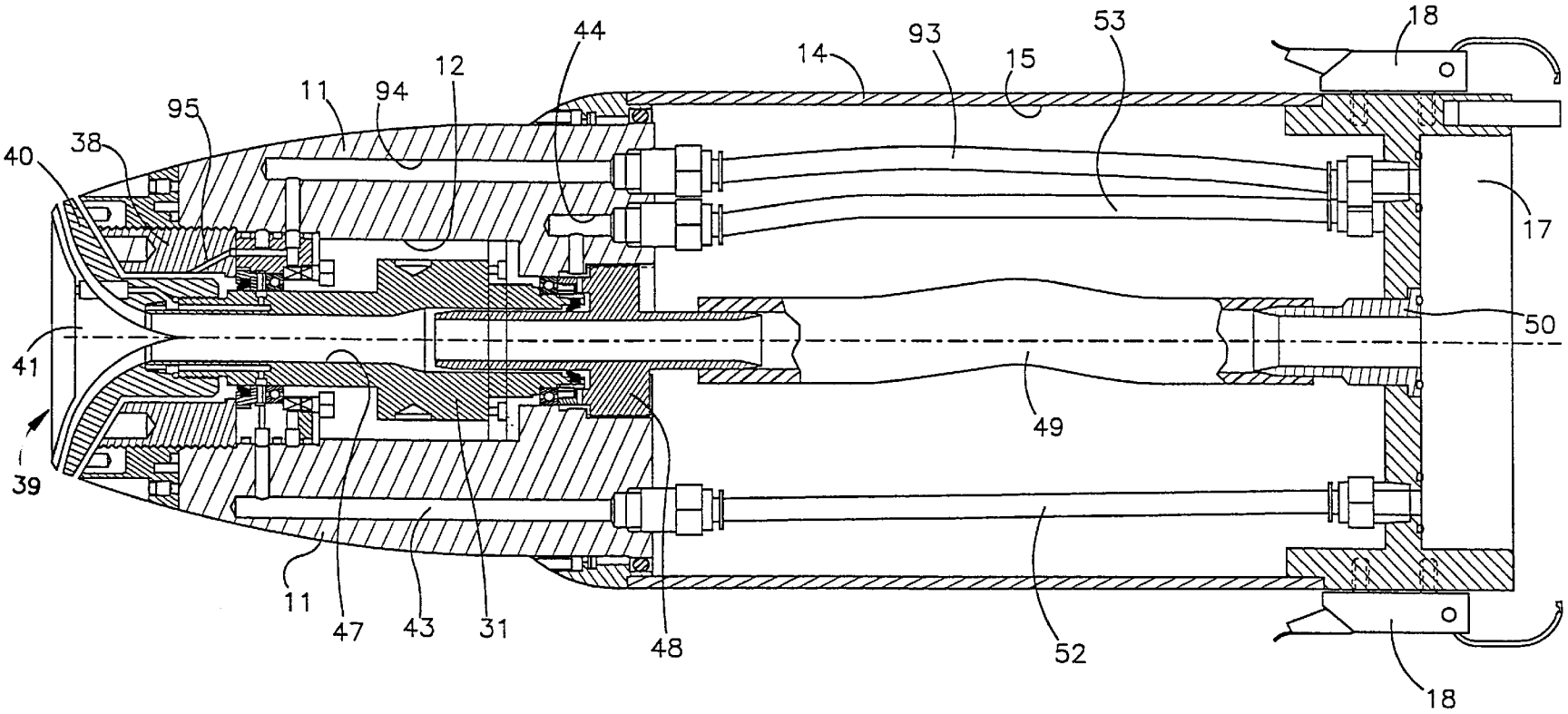
FIG. 8 is another sectional view of the spray gun taken along line 8—8 of FIG. 4.

As the spindle 31 rotates within bearing assemblies 36 and 37, the powder which flows through the spindle could enter the bearings and impede the rotation of the spindle. To prevent powder from entering the bearings, positive air pressure is supplied to the bearings through internal channels 43 and 44 in the body 11 (FIG. 8). The positive air pressure is achieved by connecting each of the channels 43 and 44 to air lines 52 and 53, respectively, which extend through the sleeve interior 15 to connections 45 and 46 (FIG. 4) on the rear end panel 17. The channel 43 exits through an opening 54 (FIG. 5) adjacent to the front bearing assembly 54. This air then flows through a passage 60 on the spindle 31 and through a passage 61 (FIGS. 2 and 2A) on the outer nozzle member 41 though a sleeve 69 which connects the inner and outer nozzle members to a chamber 70 on the inner nozzle member which supplies air to a diffuser 56. As shown in FIG. 2A, the diffuser 56 may comprise, for example, a membrane or layer of porous material on the front surface of the nozzle, such as that disclosed in U.S. Pat. No. 5,582,347, the disclosure of which is incorporated by reference herein in its entirety. The other air channel 44 exits through an opening 57 (FIG. 6) adjacent to the rear bearing assembly 37. Preferably, the air pressure from the openings 54 and 57 is maintained at around 15–25 psi, and since the openings 54 and 57 are not sealed to the chamber, air from these openings leaks into the chamber, and the entire chamber 12 becomes pressurized to a positive air pressure. Air can escape from the opening 54 between the front bearing assembly 36 and the spindle 31 and from the opening 57 between the rear bearing assembly 37 and the spindle 31. As the air escapes from the rear bearing assembly 37, it is channeled around the bearing 37 and through the annular gap 51, and eventually it enters the passageway 47 in the spindle and becomes part of the powder flow. The escape of the pressurized air thus sweeps powder accumulations from the path through which the air flows, and the surfaces around the bearing assemblies 36 and 37 and the spindle 31 are thus maintained relatively free of powder. The flow of air through the annular gap 51 also prevents powder from flowing from the powder flow path of the passageway 47 into areas around the spindle 31 and the bearings 36 and 37. This escape of air effectively creates an air seal at the annular gap 51 which is formed where the stationary tube 48 engages the rotating spindle 31. When a rotating member engages a stationary member, it is necessary to provide a rotary seal of some kind to prevent powder from leaking from the flow path, and the positive pressure in the chamber 12 and the escape of air from the chamber through the annular gap 51 provides such a rotary seal between the stationary tube 48 and the rotating spindle 31.

While the aforementioned U.S. Pat. No. 5,582,347 discloses a diffuser is used on a static or non-rotating front surface, the present invention uniquely adopts this feature for use on the front surface of a rotating distributor. The diffuser 56 also assists in the inhibition of agglomerate formation in the powder. In the past powder has built up on this surface due to eddy currents in the powder air stream and the charging of the powder. As this build-up has increased in mass, it eventually was flung off due to the rotation of the distributor, and it ended up on the surface being coated, producing one or more "powder balls." The diffuser 56 with its porous membrane with the diffuser air effectively eliminates any build up on the front surface of the distributor.

The escape of air through the annular gap 51 provides a suitable seal during normal operations of the gun. However, it will usually be necessary from time to time to clean the gun or to purge the system of powder. This is often accomplished by providing a relatively high pressure blast of air through the supply hose. The pressure of this momentary air blast can be sufficient to overcome the pressure in the chamber 12, and it would force powder-laden air back through the annular gap 51 and into the bearing assembly 37. This blast of air would also force powder-laden air back through the front bearing assembly 36. If enough powder enters the bearing assemblies, the heat generated by the friction can cause the powder to cure, creating drag which would seriously slow the rotation of the spindle and could cause the spindle to lockup in extreme cases. At the front bearing assembly 36, a similar situation can develop during maintenance cleaning, as it is common practice for workers to clean off powder spray equipment by using a high pressure air gun to blow the powder from the gun. This high pressure air gun can be directed into the gun where in can force powder through the front bearing assembly 36.

To prevent this backflow of air, sealing members 58 and 59 (FIGS. 5 and 6) are provided at the front bearing assembly 36 and at the annular gap 51, respectively. Each of the sealing members 58 and 59 is in the form a conventional lip seal made of a suitable elastomeric material, and mounted around the outer periphery. The sealing members 58 and 59 are mounted such that the inner portion of the seal does not firmly seal against the inner member, but only rests lightly against the inner member so that it can be moved away by the positive air pressure from the openings. One of the sealing members 58 is mounted around its outer periphery to the nonrotating bearing retainer 38 adjacent to the front bearing assembly 36, and the inner edge of the sealing member 58 lightly rests against the outer surface of the rotating spindle 31. The other sealing member 59 is mounted around its outer periphery to the rotating spindle 31 adjacent to the rear bearing assembly 37 and its inner edge lightly rests against the outer surface of the nonrotating tube 48 at the location of the annular gap 51. Each of the sealing members 58 and 59 is flexible enough to allow pressure of the air from the openings 54 and 57 to cause the sealing member to flex slightly away from the exterior surface of the spindle 31 or the tube 48, so that the spindle 31 can rotate freely without any frictional drag being created by the sealing member. The escape of air from the openings 54 and 57 around the inside of the sealing members 58 and 59 prevents the infiltration of powder into the bearing assemblies 36 and 37. If a relatively high reverse pressure is applied, such as a purge pulse or external air pressure blowoff, the sealing members 58 and 59 are momentarily forced back against the exterior surfaces of the spindle 31 and tube 48, preventing powder in the flow path from being blown back into the bearing assemblies 36 and 37. The sealing members 58 and 59 thus act somewhat like flapper check valves in allowing air to flow from the chamber 12 but preventing back flow of air toward the bearing assemblies 36 and 37.

In order to provide the capability of holding the spindle 31 in a fixed nonrotating position when attaching or removing the nozzle assembly 39, a spindle locking assembly 62 is provided in the body 11. The spindle locking assembly 62 comprises a locking member 63 (FIG. 2) capable of moving radially within a bore in the body 11. One end 64 of the locking member 63 extends from the exterior of the body 11 and the other end 65 is capable of projecting into one of several shallow holes 66 formed around the exterior of the spindle 31. The locking member 63 is urged radially outwardly by a spring 67 and is held inwardly by a conventional retaining clip 68. As the end 64 is locking member is depressed, the other end 65 of the locking member engages one of the holes 66 to hold the spindle 31 in place and prevent the spindle from rotating. As the end 64 is released from the retaining clip 68, the spring 67 pushes the locking member 63 radially outwardly to release the spindle 31. By using the spindle locking assembly 62 to hold the spindle 31 stationary and to prevent rotation of the spindle when attaching or removing the nozzle assembly 39, the present invention avoids the use of special tools which were necessary with prior art spray guns.

Electrical power to charge the powder enters the gun through an electrical connection 73 located in the rear end panel 17. The connection 73 is connected to a high-voltage multiplier 74 mounted in the sleeve interior 15 between the body 11 and the rear end panel 17. The multiplier 74 can be the same as or similar to those used in other electrostatic powder spray guns. The multiplier 74 is connected to a limiting resistor 75 located within the body 11, and the resistor 75 is connected to a conductive O-ring 76 located in a groove between the body 11 and the front end cap 13. A plurality of electrodes 77 are mounted in the front of the end cap 13 and extend from the front of the gun around the outer radial periphery of the nozzle assembly 39. Although any number of electrodes can be used, preferably two or three electrodes are used, with the electrodes equally spaced around the nozzle assembly. In the illustrated embodiment, two electrodes 77 are used, each 180° with respect to each other. The tip of each electrode 77 extends from the front surface of the end cap 13 and charges the powder as it exits from the gap 42 formed in the nozzle assembly 39. By locating the electrodes 77 outside of the powder spray path, distinct mechanical advantages are achieved.

The rotational speed of the spindle 31 is varied by changing supply voltage to the motor 22. The electric motor 22 with a speed sensor so that the speed of the motor may be measured. If a pneumatic or air motor is used, the speed of the motor is varied by changing the pressure of the air supplied to the motor. However, the same air pressure to the air motor will not always produce the same spindle speed due to changes in powder flow rates and specific gravity of the powder, due to frictional drag of the powder which varies according to the powder flow rate. Therefore, it may be necessary to measure directly the rotational speed of the spindle 31. Spindle speed can be detected by a speed detector comprising a sensor 82 (FIG. 7) located within the sleeve interior 15. A pair of fiber optic lines 83 extend from the sensor 82 through a bore 84 in the body 11. The ends of the fiber optic lines 83 are aimed at the rotating gear 29. The gear 29 includes the pair of screws 30 which are of contrasting appearance with the gear. For example, if the gear 29 is made of a material which is dark in color or light absorbent, the screws 30 would be made of a light or bright or shiny material. One of the fiber optic lines 83 carries light to illuminate the screws 30 on the gear 29. The other of the lines 83 carries light reflected from the screws 30 back to the sensor 82. As the gear 29 rotates, light reflected by the screws 30 and carried to the sensor 82 by the fiber optic lines 83 is used to detect the presence of the screws 30 and thereby detect each rotation of the gear 29. The speed of rotation of the gear 29 matches the speed of rotation of the spindle 31, so the spindle speed is determined thereby by the sensor 82. The sensor 82 can be connected to a suitable output device or control device through an electrical connection located on the rear end panel 17. The speed detector can be connected to the air supply to the air motor in accordance with known techniques so that the speed of the spindle can be controlled.

The rear end panel 17 (FIG. 4) may also be provided with two or more additional air connections 90, 91 and 92. One of these connections 90 may be connected to a hose 93 (FIG. 8) which extends through the interior of the sleeve 14 and is connected to a channel 94 extending in the body 11. The channel 94 is connected to a passage 95 in the bearing retainer 38 which feeds the air between the bearing retainer 38 and the outer nozzle member 41. The air exits the spray gun adjacent to the electrodes 77 where it cools or shapes the air around the electrodes. The other connections 91 and 92 may be used for additional capabilities, such as, for air supplied to the portals on the front of the end cap 13 to shape the flow of powder existing from the nozzle assembly, or for air used to sweep accumulated powder.

Various modifications can be made to the preferred form of the invention just described. For example, instead of an electric motor, other suitable motors can be used which drive the spindle at variable speeds and which would reliably drive the spindle at speeds less than 2,500 rpm.

A feature of the present invention is that the spindle and the distributor rotate at a speed of less than 2,500 rpm. This results in a rotating distributor which rotates at speeds which are much slower than the speeds of the prior art spray guns. Turbines, such as those used in prior art spray guns, can operate effectively only as slow as about 2,500 rpm. At slower speeds they will not operate at a consistent or even speed, or may not operate at all. The present invention avoids the use of a turbine to turn the distributor, so that it can achieve much slower speeds effectively. This avoids the problem of powder fusing which can result if the distributor rotates at a higher speed and the powder particles acquire a kinetic energy which will turn to heat as the powder particles hit the distributor.

Figure 9:
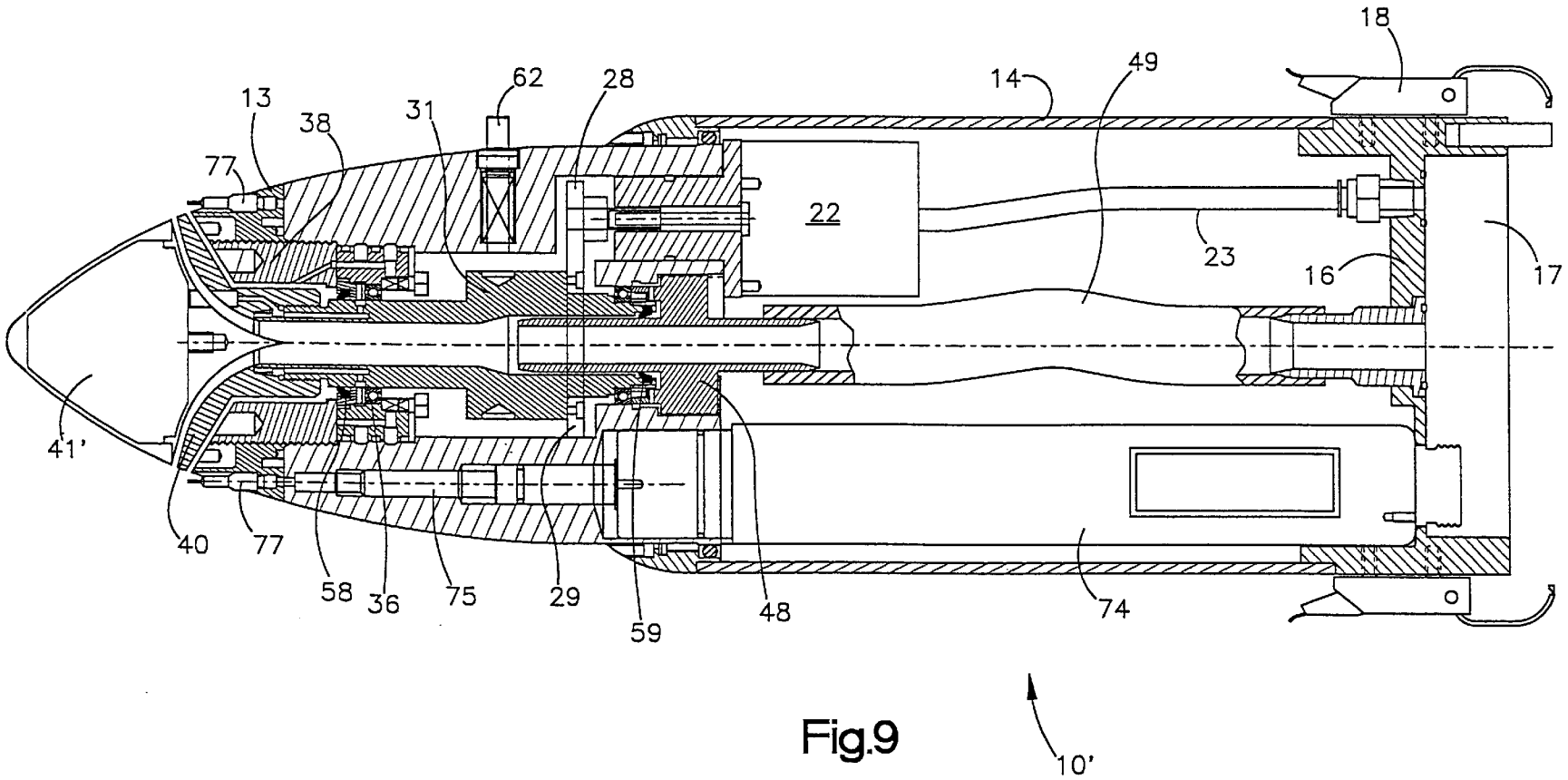
FIG. 9 is a side sectional view similar to FIG. 1 of an alternative embodiment of the present invention.

The configuration of the spray gun can also be modified for specific purposes. FIG. 9 shows such a modified spray gun 10' having an outer nozzle member 41' having a bullet nose cone at the forward end of the spray gun which rotates with the spindle. The bullet nose cone eliminates the need for the diffuser face function by aerodynamically managing the air flow to allow for a streamline body profile. This profile presents a three-dimensional shape for intermittent purging with an external blow-off element which would utilize the same pneumatic supply as the diffuser face feature. The diffuser and the external blow-off procedure would, thus not be used at the same time. This spray gun configuration may be advantageous in applications utilizing powder products having mean particle sizes smaller than 15 microns. The interior configuration of the spray gun 10' of FIG. 9 is otherwise identical to the spray gun 10 of FIG. 1, and includes the air supply which would be connected to the diffuser, although this air supply is not used for this purpose in the spray gun 10'.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiments herein shown and described nor in any other way that is inconsistent with the extent to which the progress in the art has been advanced by the invention.

What is claimed is:

1. A spray gun for spraying coating material, which comprises:

a housing including a body;

a spindle mounted for rotation within the body, the spindle having a rotating tubular passageway therethrough for the flow of coating material, the passageway rotating with the spindle, the passageway having first and second ends;

a nonrotating flow tube through which the coating material powder flows into the rotating tubular passageway, one end of the flow tube extending partially into the first end of the passageway and spaced within the passageway from the second end, a gap being formed between the nonrotating flow tube and the rotatable spindle, the gap communicating with a supply of pressurized air whereby pressurized air escapes through the gap to provide a rotary seal between the tube and the spindle;

a flexible sealing member mounted on one of the spindle and the flow tube and capable of engaging the other of the spindle and the flow tube to seal the gap to prevent material in the passageway from entering the gap, the sealing member urged away from engagement by the pressurized air;

a distributor communicating with the passageway and attached for rotation with the spindle, coating material flowing from the passageway into the distributor to be sprayed from the gun; and a drive mechanism located within the body and connected to rotate the spindle and the distributor.

2. A spray gun as in claim 1, wherein the sealing member is mounted on the rotating spindle and engages the nonrotating flow tube.

3. A spray gun as in claim 1, comprising in addition, a second sealing member mounted to engage the spindle.

4. A spray gun as in claim 1, wherein spindle and the distributor rotate about the central longitudinal axis of the body, and wherein the drive mechanism is located along an axis radially spaced from the longitudinal axis of the body.

5. A spray gun as in claim 1, comprising in addition a plurality of discrete electrodes mounted to extend from the exterior of the housing, the electrodes located radially beyond the outer diameter of the distributor.

6. A powder spray gun, which comprises:

a housing including a body having a central longitudinal axis, the body including a chamber which is connected to a supply of pressurized air;

a powder flow path extending through the body to a powder outlet, the powder flow path generally located along the central longitudinal axis of the body;

a rotatable powder distributor located at the powder outlet;

a drive mechanism located within the housing along an axis radially spaced from the longitudinal axis of the body and connected to the distributor to rotate the distributor at speeds of from 750 to 1,500 rpm;

a spindle mounted in the chamber and connected for rotation with the distributor, the spindle having a central passageway forming a portion of the powder flow path;

at least one bearing assembly supporting the spindle for rotation; and a nonrotating flow tube through which powder flows into the passageway, a gap being formed between the nonrotating flow tube and the rotatable spindle, the gap communicating with the chamber whereby pressurized air from the chamber escapes through the gap to provide a rotary seal between the tube and the spindle and prevents powder from flowing into the bearing assembly.

7. A powder spray gun as in claim 6, comprising in addition a flexible sealing member mounted on one of the spindle and the flow tube and capable of engaging the other of the spindle and the flow tube to seal the gap to prevent material in the passageway from entering the gap, the sealing member urged away from engagement by pressurized air from the chamber.

8. A spray gun for spraying coating material, which comprises:

a housing including a body;

a spindle mounted for rotation within the body, the spindle having a rotating tubular passageway therethrough for the flow of coating material, the passageway rotating with the spindle, the passageway having first and second ends;

a nonrotating flow tube through which the coating material flows, the coating material flowing from the nonrotating flow tube into the rotating tubular passageway, one end of the flow tube extending partially into the first end of the passageway, said one end of the flow tube being spaced within the passageway from the second end of the passageway;

a distributor communicating with the passageway and attached for rotation with the spindle, coating material flowing from the passageway into the distributor to be sprayed from the gun; and a drive mechanism located within the body and connected to rotate the spindle and the distributor.

9. A spray gun as in claim 8, wherein spindle and the distributor rotate about the central longitudinal axis of the body, and wherein the drive mechanism is located along an axis radially spaced from the longitudinal axis of the body.

10. A spray gun as in claim 8, comprising in addition a plurality of discrete electrodes mounted to extend from the exterior of the housing, the electrodes located radially beyond the outer diameter of the distributor.

11. A spray gun as in claim 8, wherein the body includes a chamber which is connected to a supply of pressurized air, and wherein air can escape from the pressurized chamber into the passageway.

12. A spray gun as in claim 11, wherein the spindle has an outer periphery and the coating material is swept from the periphery of the spindle by escape of pressurized air from the chamber into the passageway.

13. A spray gun for spraying coating material, which comprises:

a housing including a body, the body including a chamber which is connected to a supply of pressurized air;

a spindle mounted for rotation within the body, the spindle having a rotating tubular passageway therethrough for the flow of coating material, the passageway rotating with the spindle, the passageway having first and second ends;

a nonrotating flow tube through which the coating material flows into the rotating tubular passageway, one end of the flow tube extending partially into the first end of the passageway and spaced within the passageway from the second end;

a distributor communicating with the passageway and attached for rotation with the spindle, coating material flowing from the passageway into the distributor to be sprayed from the gun;

a drive mechanism located within the body and connected to rotate the spindle and the distributor;

at least one bearing assembly supporting the spindle for rotation, a gap being formed between the nonrotating flow tube and the rotatable spindle, the gap communicating with the chamber whereby pressurized air from the chamber escapes through the gap to provide a rotary seal between the tube and the spindle and prevents the coating material from entering the bearing assembly.

14. A powder spray gun as in claim 13, comprising in addition a flexible sealing member mounted on one of the spindle and the flow tube and capable of engaging the other of the spindle and the flow tube to seal the gap to prevent material in the passageway from entering the gap, the sealing member urged away from engagement by pressurized air from the chamber.

15. A spray gun for coating material, which comprises:

a housing having a body;

a chamber within the body, the chamber connected to an air supply to pressurize the chamber;

a spindle mounted for rotation within the chamber, the spindle having a central elongated tubular passageway forming a portion of a flow path for the coating material, the passageway rotating with the spindle, the passageway having first and second ends;

at least one bearing assembly supporting the spindle for rotation;

a nonrotating flow tube through which the coating material flows into the rotating tubular passageway, one end of the flow tube extending partially into the first end of the passageway and spaced within the passageway from the second end, a gap being formed between the end of the nonrotating flow tube and the passageway within the rotatable spindle, the gap communicating with the chamber whereby pressurized air from the chamber escapes through the gap to provide a rotary seal between the tube and the spindle and prevents the coating material from entering the bearing assembly;

a distributor attached for rotation with the spindle and receiving the coating material from the second end of the passageway to be sprayed from the gun; and a drive mechanism located within the housing and connected to rotate the spindle and the distributor.

16. A spray gun as in claim 15, wherein spindle and the distributor rotate about the central longitudinal axis of the body, and wherein the drive mechanism is located along an axis radially spaced from the longitudinal axis of the body.

17. A spray gun as in claim 15, comprising in addition a plurality of discrete electrodes mounted to extend from the exterior of the housing, the electrodes located radially beyond the outer diameter of the distributor.

18. A powder spray gun, which comprises:

a housing including a body, a powder flow path extending through the body;

a powder distributor mounted for rotation on the body, the distributor having an inner nozzle member and an outer nozzle member and forming a portion of the powder flow path downstream of the body and providing a powder outlet, the powder flow path portion of the distributor being formed between the inner nozzle member and the outer nozzle member and including a nozzle entrance having a first cross-sectional area, a nozzle discharge outlet having a second cross-sectional area, and an intermediate region between the nozzle entrance and the discharge outlet having a third cross-sectional area which is smaller than either the first or the second cross-sectional area, the first cross sectional area, the second cross sectional area and the third cross sectional area being formed between a continuously curved surface of the inner nozzle member and a continuously curved surface of the outer nozzle member; and a drive mechanism located within the housing and connected to the distributor to rotate the distributor.

19. A powder spray gun as in claim 18, wherein with the distributor includes a conical projection located within the powder flow path at the nozzle entrance.

20. A powder spray gun as in claim 18, wherein the powder flow path has a width at the intermediate region of between 0.015 and 0.020 inches.

21. A powder spray gun as in claim 18, wherein the intermediate region is located closer to the discharge outlet than to the nozzle entrance.

22. A powder spray gun as in claim 21, wherein the narrowest width of the powder flow path portion is located at the intermediate region, and this narrowest width is located at least 70% of the length of the powder flow path portion from the nozzle entrance.

23. A powder spray gun as in claim 22, the narrowest width is located at least 80% of the length of the powder flow path portion from the nozzle entrance.

24. A powder spray gun, which comprises:

a housing including a body;

a powder flow path extending through the body to a powder outlet;

a rotatable powder distributor located at the powder outlet, the distributor having a diffuser on its exterior surface, the diffuser communicating with a supply of pressurized air to allow air to flow through the exterior surface of the distributor to prevent powder agglomerates from accumulating on the rotating distributor; and a drive mechanism located within the housing and connected to the distributor to rotate the distributor.

25. A powder spray gun as in claim 24, wherein the drive mechanism rotates the distributor at speeds of from 750 to 1,500 rpm.

26. A rotary spray device for particulate coating material, which comprises:

a housing having a body;

a chamber within the body, the chamber connected to an air supply to fill the chamber with pressurized air;

a spindle mounted for rotation, the spindle having a central tubular passageway forming a portion of a flow path for the coating material, the passageway rotating with the spindle, the passageway having first and second ends;

at least one bearing assembly supporting the spindle for rotation;

a nonrotating flow tube having a rearward end connected to a supply of the particulate coating material and having a forward end through which the coating material flows into the rotating tubular passageway, the flow tube being in fluid communication with the first end of the rotating passageway, a gap being formed between the forward end of the nonrotating flow tube and the passageway, the gap communicating with the chamber whereby pressurized air from the chamber flows through the gap between the nonrotating tube and the rotating spindle to prevent at least some of the coating material from flowing through the gap;

a distributor attached for rotation with the spindle and receiving the coating material from the second end of the passageway to be sprayed from the spray device; and a drive mechanism located within the housing and connected to rotate the spindle and the distributor.

27. A spray gun as in claim 26 wherein at least a portion of one end of the nonrotating flow tube extends into a portion of the rotating spindle.

28. A rotary distributor type powder spray gun, which comprises:

a housing including a rotating body having a central longitudinal axis;

a rotating powder flow path including a tubular portion extending through the body to a powder outlet, the powder flow path generally located along the central longitudinal axis of the body, the powder flow path further including a portion having a generally cone-shaped curved member, the powder material flowing from a source of powder through the tubular portion into the cone-shaped member, the cone-shaped member redirecting the powder from the axial direction to a direction having a radial component prior to reaching the powder outlet, the rotating tubular portion of the flow path imparting rotation to at least some of the powder flowing through the tubular portion prior to the powder arriving at the curved member; and a drive mechanism located within the housing and connected to the rotating body to rotate the rotating body.

29. A rotary distributor type powder spray gun as in claim 28, comprising in addition a nonrotating flow tube in fluid communication with the rotating tubular portion and providing powder from the source to the rotating flow path.

30. A rotary distributor type powder spray gun as in claim 29, wherein a gap is formed between the one end of the nonrotating flow tube and the rotating tubular portion, the gap communicating with a supply of pressurized air whereby the pressurized air flows through the gap between the nonrotating tube and the rotating tubular member to prevent at least some of the powder from flowing into the gap.

* * * * *

UNITED STATES PATENT AND TRADEMARK OFFICE

CERTIFICATE OF CORRECTION

PATENT NO. : 6,105,886

DATED : Aug. 22, 2000

INVENTOR(S) : Hollstein et al.

It is certified that error appears in the above-identified patent and that said Letters Patent is hereby corrected as shown below:

Column 9, line 50, after "diffuser", the word "is" should be deleted.
Column 13, line 5, after "rial", the word "powder" should be deleted.
Column 14, line 6, after "A", the word "powder" should be deleted.

UNITED STATES PATENT AND TRADEMARK OFFICE

CERTIFICATE OF CORRECTION

PATENT NO. : 6,105,886

DATED : Aug. 22, 2000

INVENTOR(S) : Hollstein et al.

It is certified that error appears in the above-identified patent and that said Letters Patent is hereby corrected as shown below:

Column 9, line 50, after "diffuser", the word "is" should be deleted.
Column 13, line 5, after "rial", the word "powder" should be deleted.
Column 14, line 6, after "A", the word "powder" should be deleted.

Signed and Sealed this

First Day of May, 2001

*Attest:*

Nicholas P. Godici

NICHOLAS P. GODICI

*Attesting Officer*

*Acting Director of the United States Patent and Trademark Office*